US005736993A

United States Patent [19]

Regimbal et al.

[11] Patent Number: 5,736,993

[45] Date of Patent: Apr. 7, 1998

[54] ENHANCED PERFORMANCE DROP-ON-DEMAND INK JET HEAD APPARATUS AND METHOD

[75] Inventors: Laurent A. Regimbal, Boise, Id.; Ronald F. Burr, Wilsonville, Oreg.

[73] Assignee: Tektronix, Inc., Wilsonville, Oreg.

[21] Appl. No.: 542,237

[22] Filed: Oct. 12, 1995

Related U.S. Application Data

[63] Continuation of Ser. No. 139,349, Oct. 19, 1993, abandoned, which is a continuation-in-part of Ser. No. 100,504, Jul. 30, 1993, Pat. No. 5,495,272.

[51] Int. Cl.[6] ..... B41H 2/45

[52] U.S. Cl. ..... 347/11; 347/70; 347/94

[58] Field of Search ..... 347/11, 10, 68, 347/70, 71, 94

[56] References Cited

U.S. PATENT DOCUMENTS

| | | | |
|---|---|---|---|
| 4,459,601 | 7/1984 | Howkins | 347/68 |
| 4,563,689 | 1/1986 | Murakami | 347/11 |
| 4,625,221 | 11/1986 | Mizuno | 347/10 X |
| 4,730,197 | 3/1988 | Raman et al. | 347/68 |
| 5,124,716 | 6/1992 | Roy | 347/11 |
| 5,155,498 | 10/1992 | Roy | 347/11 |
| 5,170,177 | 12/1992 | Stanley et al. | 347/11 |
| 5,212,497 | 5/1993 | Stanley et al. | 347/10 |
| 5,495,270 | 2/1996 | Burr | 347/10 |

*Primary Examiner*—Joseph W. Hartary

*Attorney, Agent, or Firm*—Ralph D 'Alessandro; Richard B. Preiss

[57] ABSTRACT

An ink-jet apparatus (10) and method provides high-resolution, high-speed printing by providing a transducer drive waveform (160) having a spectral energy distribution (170) that concentrates energy (172) around a frequency associated with a dominant (Helmholtz) ink drop ejection mode and that suppresses energy (174) at resonant frequencies associated with ink inlet (18) and ink outlet structures (24, 26, 28, 14) of the ink-jet head. Spectral energy distribution principles used to shape the transducer drive waveform can be used to enhance the jetting performance of many conventional ink-jet heads.

16 Claims, 6 Drawing Sheets

ENHANCED PERFORMANCE DROP-ON-DEMAND INK JET HEAD APPARATUS AND METHOD

RELATED APPLICATIONS

This application is a continuation of application Ser. No. 08/139,349 filed Oct. 19, 1993, now abandoned, which is a continuation-in-part of U.S. patent application Ser. No. 08/100,504 filed Jul. 30, 1993 for a METHOD AND APPARATUS FOR PRODUCING DOT SIZE MODULATED INK JET PRINTING now U.S. Pat. No. 5,495,272.

TECHNICAL FIELD

This invention relates to ink-jet printing and more particularly to a method and an apparatus for ejecting ink drops from an ink-jet head at substantially constant ejection velocities over a wide range of ejection repetition rates.

BACKGROUND OF THE INVENTION

There are previously known apparatus and methods for ejecting ink drops from an ink-jet print head at a high repetition rate. The physical laws governing ink-jet drop formation and ejection are complexly interactive. U.S. Pat. No. 4,730,197, issued Mar. 8, 1988 for an IMPULSE INK JET SYSTEM describes and characterizes numerous interactions among ink-jet geometric features, transducer drive waveforms, ink meniscus and pressure chamber resonance, and ink drop ejection characteristics. A multiple-orifice print head is thereafter described in which "dummy channels" and compliant chamber walls are provided to minimize drop nonuniformity caused by jet-to-jet cross-talk. Increased drop ejection rates are achieved with piezoelectric transducer ("PZT") drive waveform compensation techniques that account for print head resonances, fluidic resonances, and past droplet timing compensation. The adaptive PZT drive waveform circuitry and complex ink-jet head structures achieve drop ejection rates "up to and including seven KHz."

U.S. Pat. No. 5,170,177, issued Dec. 8, 1992, for a METHOD OF OPERATING AN INK JET TO ACHIEVE HIGH PRINT QUALITY AND HIGH PRINT RATE, assigned to the assignee of the present application, describes PZT drive waveforms having a spectral energy distribution that is minimized at the "dominant acoustic resonant frequency." The dominant frequency is described as including any of the meniscus resonance frequency, Helmholtz resonance frequency, PZT drive resonance frequency, and various acoustic resonance frequencies of the different channels and passageways forming the ink-jet print head. Suppressing PZT energy at the ink-jet outlet channel resonant frequency is said to produce a constant ink drop volume and ejection velocity at drop ejection rates up to 10 KHz.

Subjecting ink drops to an electric field is known to increase ink drop ejection repetition rate as described in copending U.S. patent application Ser. No. 07/892,494 of Roy et al., filed Jun. 3, 1992, for METHOD AND APPARATUS FOR PRINTING WITH A DROP-ON-DEMAND INK-JET PRINT HEAD USING AN ELECTRIC FIELD that is assigned to the assignee of the present application. A time invariant electric field provides time-to-paper compensation for ink drops of different volumes, provides a wider range of drop volume ejection, and provides ink drop ejection with decreased PZT drive energy, thereby allowing an increased maximum drop ejection rate of "up to eight KHz or greater." Unfortunately, the electric field apparatus adds complexity, cost, and shock hazard. Reliability and print quality are possible problems because the electric field attracts dust.

What is needed, therefore, is a simple, ink-jet print head system that provides substantially constant ink drop ejection velocity, without using an electric field, for ink drops ejected at rates ranging from zero to beyond 13,000 drops per second.

SUMMARY OF THE INVENTION

An object of this invention is, therefore, to provide an ink-jet apparatus and printing method for ejecting ink drops from an ink-jet head at substantially constant ejection velocities over a wide range of ejection repetition rates.

Another object of this invention is to provide an improved method of driving a conventional ink-jet head to enhance its jetting performance without requiring an electric field.

Accordingly, an ink-jet apparatus and method according to this invention provides high-resolution, high-speed printing by providing a transducer drive waveform having a spectral energy distribution that concentrates energy around a frequency associated with a dominant (Helmholtz) ink drop ejection mode or integer fractions or multiples (subharmonics or harmonics) thereof and that suppresses energy at resonant frequencies associated with ink inlet and ink outlet structures of the ink-jet head.

It is an advantage that the invention provides for ejection of ink drops that have substantially the same ejection velocity over a wide range of ejection repetition rates, thereby providing high-resolution, high-speed printing.

It is another advantage that the invention provides drive waveform shaping principles usable to enhance the jetting performance of conventional ink-jet heads.

Additional objects and advantages of this invention will be apparent from the following detailed description of a preferred embodiment thereof that proceeds with reference to the accompanying drawings.

DETAILED DESCRIPTION OF PREFERRED EMBODIMENT

Figure 1:
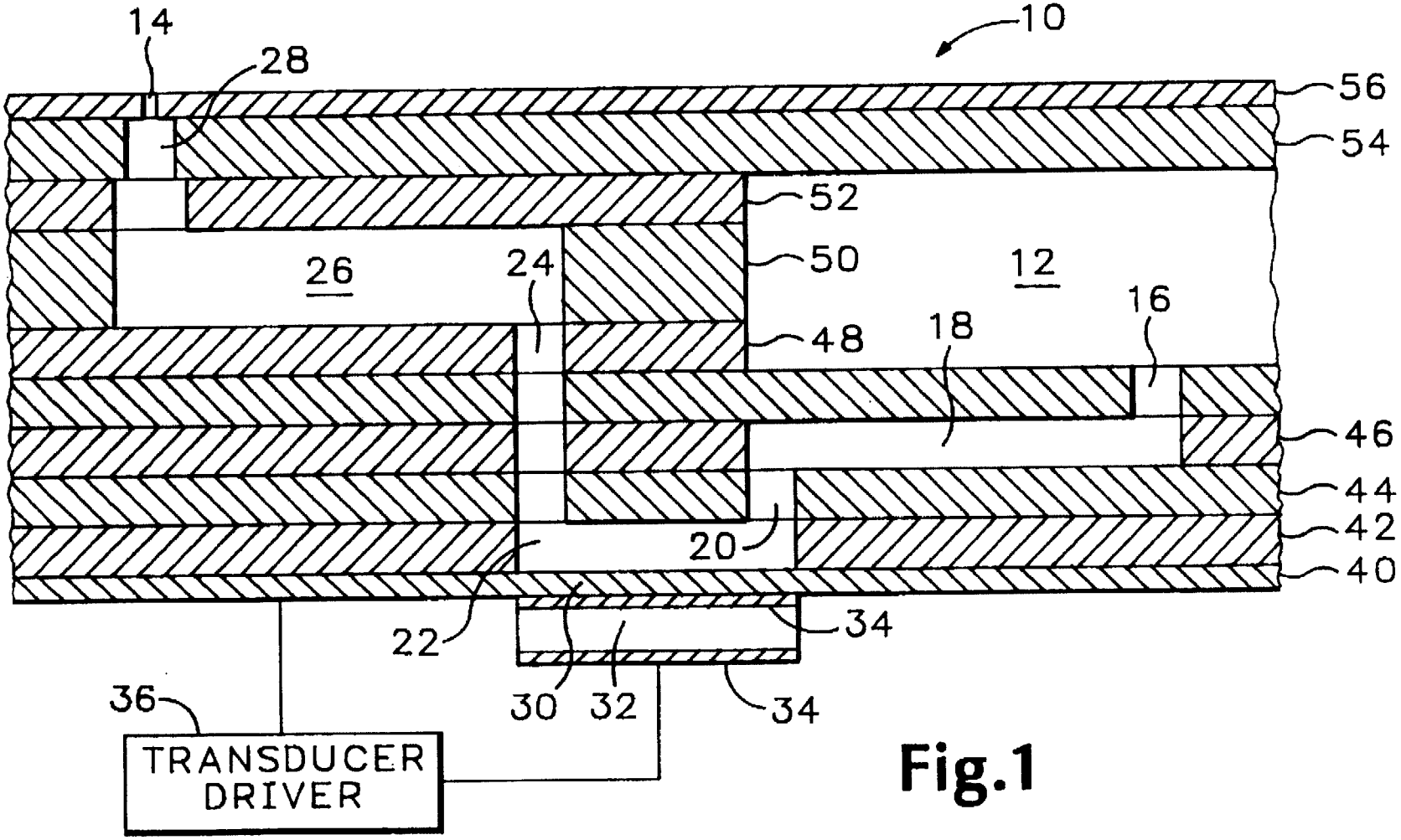
FIG. 1 is a diagrammatical cross-sectional view of a PZT-driven ink-jet representative of one found in a typical ink-jet array print head of a type used with this invention.

FIG. 1 shows a cross-sectional view of an ink-jet 10 that is part of a multiple-orifice ink-jet print head suitable for use with the invention. Ink-jet 10 has a body that defines an ink manifold 12 through which ink is delivered to the ink-jet print head. The body also defines an ink drop forming orifice 14 together with an ink flow path from ink manifold 12 to orifice 14. In general, the ink-jet print head preferably includes an array of orifices 14 that are closely spaced from one another for use in printing drops of ink onto a print medium (not shown).

A typical color ink-jet print head has at least four manifolds for receiving black, cyan, magenta, and yellow ink for use in black and color printing. However, the number of such manifolds may be varied depending upon whether a printer is designed to print solely in black ink or with less than a full range of color. Ink flows from manifold 12, through an inlet port 16, an inlet channel 18, a pressure chamber port 20, and into an ink pressure chamber 22. Ink leaves pressure chamber 22 byway of an offset channel port 24, flows through an optional offset channel 26 and an outlet channel 28 to nozzle 14, from which ink drops are ejected.

Ink pressure chamber 22 is bounded on one side by a flexible diaphragm 34. An electromechanical transducer 32, such as a PZT, is secured to diaphragm 30 by an appropriate adhesive and overlays ink pressure chamber 22. In a conventional manner, transducer 32 has metal film layers 34 to which an electronic transducer driver is electrically connected. Although other forms of transducers may be used, transducer 32 is operated in its bending mode such that when a voltage is applied across metal film layers 34, transducer 32 attempts to change its dimensions. However, because it is securely and rigidly attached to the diaphragm, transducer 32 bends, deforming diaphragm 30, thereby displacing ink in ink pressure chamber 22, causing the outward flow of ink through passage 26 to nozzle 14. Refill of ink pressure chamber 22 following the ejection of an ink drop is augmented by reverse bending of transducer 34 and the concomitant movement of diaphragm 30.

To facilitate manufacture of the ink-jet print head usable with the present invention, ink-jet 10 is preferably formed of multiple laminated plates or sheets, such as of stainless steel. These sheets are stacked in a superimposed relationship. In the illustrated FIG. 1 embodiment of the present invention, these sheets or plates include a diaphragm plate 40 that forms diaphragm 30; an ink pressure chamber plate 42 that defines ink pressure chamber 22; a separator plate 44 that pressure chamber port 20, bounds one side of ink pressure chamber 22, and defines a portion of outlet channel port 24; an inlet channel plate 46 that defines inlet channel 18 and a portion of outlet channel port 24; another separator plate 48 that defines inlet port 16 and portions of outlet channel port 24 and manifold 12; an offset channel plate 50 that defines offset channel 26 and a portion of manifold 12; a separator plate 52 that defines portions of outlet channel 28 and manifold 12; an outlet plate 54 that defines a portion of outlet channel 28; and an orifice plate 56 that defines orifice 14 of the ink-jet.

More or fewer plates than those illustrated may be used to define the various ink flow passageways, manifolds, and pressure chambers of the ink-jet print head. For example, multiple plates may be used to define an ink pressure chamber instead of the single plate illustrated in FIG. 1. Also, not all of the various features need be in separate sheets or layers of metal. For example, patterns in the photoresist that are used as templates for chemically etching the metal (if chemical etching is used in manufacturing) could be different on each side of a metal sheet. Thus, as a more specific example, the pattern for the ink inlet passage could be placed on one side of the metal sheet while the pattern for the pressure chamber could be placed on the other side and in registration front to back. Thus, with carefully controlled etching, separate ink inlet passage and pressure chamber containing layers could be combined into one common layer.

To minimize fabrication costs, all of the metal layers of the ink-jet print head, except orifice plate 56, are designed so that they may be fabricated using relatively inexpensive conventional photo-patterning and etching processes in metal sheet stock. Machining or other metal working processes are not required. Orifice plate 56 has been made successfully using any number of processes, including electroforming with a sulfumate nickel bath, micro-electric discharge machining in 300 series stainless steel, and punching 300 series stainless steel, the last two approaches being used in concert with photo-patterning and etching all of the features of orifice plate 56 except the orifices themselves. Another suitable approach is to punch the orifices and use a standard blanking process to form any remaining features in the plate.

Table 1 shows acceptable dimensions for the ink-jet of FIG. 1. The actual dimensions employed are a function of the ink-jet array and its packaging for a specific application. For example, the orifice diameter of the orifices 14 in orifice plate 56 may vary from about 25 microns to about 150 microns.

TABLE 1

All dimensions in millimeters

| Feature | Length | Width | Height | Cross Section |
|---|---|---|---|---|
| Inlet port | 0.2 | .41 | .41 | Circular |
| Inlet channel | 6.4 | .30 | 0.2 | Rectangular |
| Pressure chamber port | .2 | .41 | .41 | Circular |
| Pressure chamber | .2 | 2.20 | 2.20 | Circular |
| Offset channel port | 0.8 | .41 | .41 | Circular |
| Offset channel | 2.1 | .41 | .81 | Rectangular |
| Outlet separator | .2 | .36 | .36 | Circular |
| Outlet channel | .2 | .25 | .25 | Circular |
| Orifice | .08 | .08 | .08 | Circular |

The electromechanical transducer mechanism selected for the ink-jet print heads of the present invention can comprise hexagonally kerfed ceramic transducers bonded with epoxy to the diaphragm plate 40, with each of the transducers being centered over a respective ink pressure chamber 22. For this type of transducer mechanism, the hexagonal shape is substantially circular, a shape which has the highest electromechanical efficiency with regard to volume displacement for a given area of the piezoceramic element.

Ejecting ink drops having controllable volumes from an ink-jet head such as that of FIG. 1 entails providing from transducer driver 36, multiple selectable drive waveforms to transducer 32. Transducer 32 responds to the selected waveform by inducing pressure waves in the ink that cause ink fluid flow in orifice 14. A different resonance mode is excited by each selected waveform and a different drop volume is ejected in response to each resonance mode.

Figure 2A:
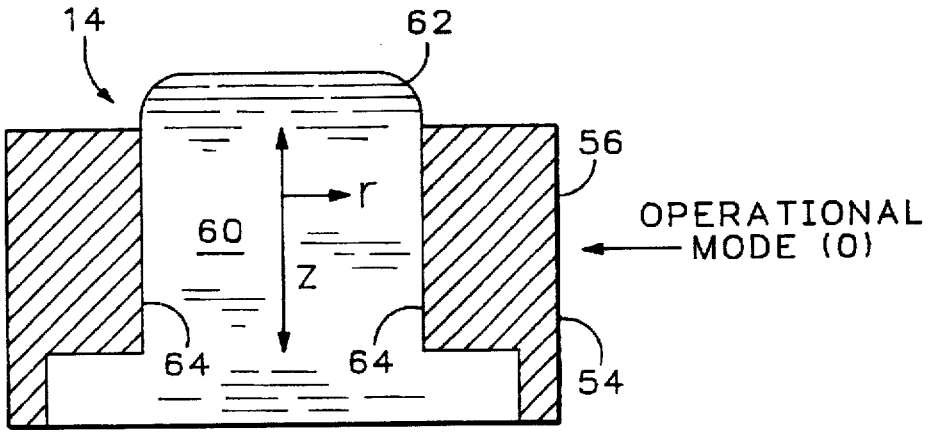
FIGS. 2A, 2B, and 2C are enlarged pictorial cross-sectional views of an orifice portion of the print head of FIG. 1 showing illustrative orifice fluid flow operational modes zero, one, and two to which this invention could be applied.
Figure 2B:
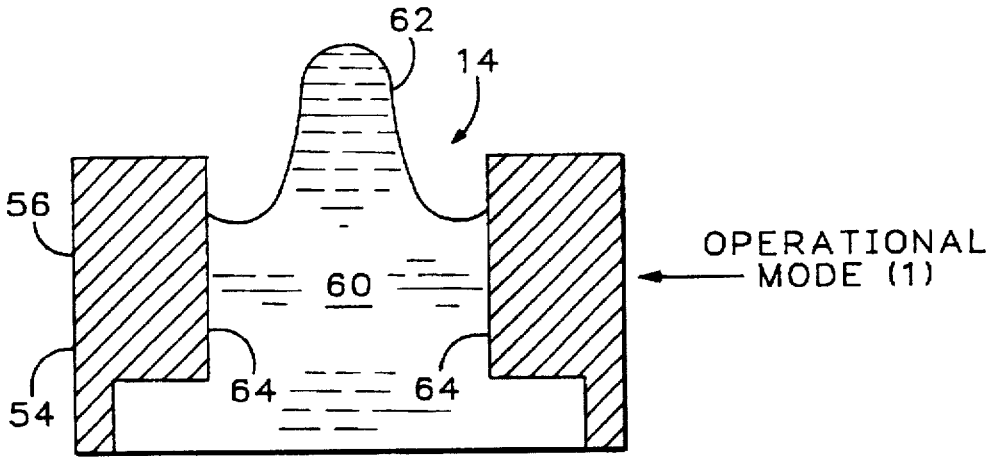
Figure 2C:
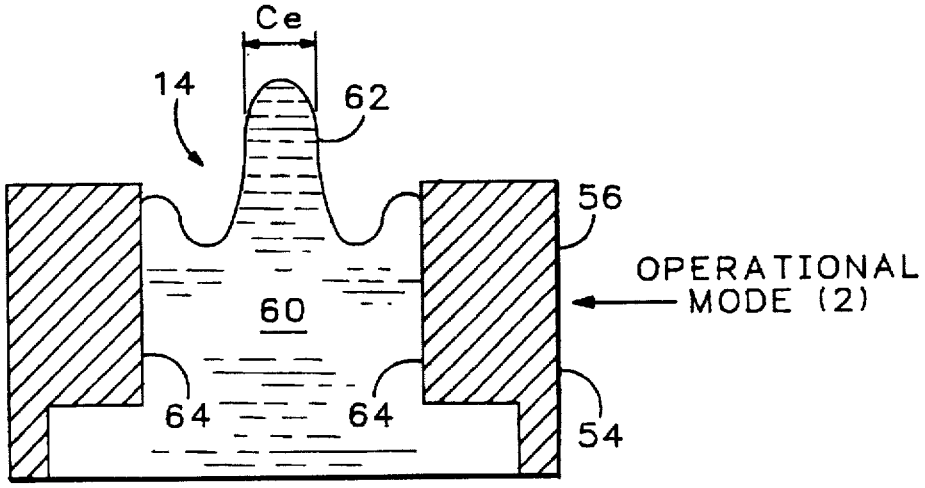

Referring to FIGS. 2A, 2B, and 2C, an ink column 60 having a meniscus 62 is shown positioned in orifice 14. Meniscus 62 is shown excited in three operational modes, referred to respectively as modes zero, one, and two in FIGS. 2A, 2B, and 2C. FIG. 2C shows a center excursion Ce of the meniscus surface of a high order oscillation mode.

In FIG. 2A, operational mode zero corresponds to a bulk forward displacement of ink column 60 within a wall 64 of orifice 14. Prior workers have based ink-jet and drive waveform design on mode zero operation but have failed to fully exploit its possibilities. Ink surface tension and viscous boundary layer effects associated with wall 64 cause meniscus 62 to have a characteristic rounded shape indicating the lack of higher order modes. The natural resonant frequency of mode zero is primarily determined by the bulk motion of the ink mass interacting with the compression of the ink inside the ink-jet (i.e., like a Helmholtz oscillator in which a "capacitive" pressure chamber 22 forms a parallel resonant circuit with "inductive" inlet channel 18 and combined outlet channel structures 24, 26, 28, and orifice 14. The geometric dimensions of the various fluidically coupled ink-jet components, such as the channels 18, 26, and 28; the manifold 12; the part 16, 20, and 22; and the pressure chamber 22, all of FIG. 1, are sized to avoid extraneous or parasitic resonant frequencies that would interact with the orifice resonance modes.

Designing drive waveforms suitable for constant drop ejection velocity over a wide range of ejection rates requires knowledge of the natural frequencies of the system elements so that a waveform can be designed that concentrates energy at frequencies near the natural frequency of the desired mode and suppresses energy at the natural frequencies of other mode(s) and extraneous or parasitic resonant frequencies that compete with the desired mode for energy. These extraneous or parasitic resonant frequencies adversely affect the ejection of ink droplets from the ink-jet orifice in several ways, including, but not limited to, ink drop size and the drop speed or the time it takes the drop to reach the print media once ejected from the orifice, thereby also affecting the drop placement accuracy on the media.

To design the waveform used to operate ink-jet 10 of FIG. 1, we must know the fundamental resonant frequencies of inlet channel 18 and the combined outlet channel structures that include offset channel port 24, offset channel 26, outlet channel 28, and orifice 14.

Using basic organ-pipe frequency calculations, and assuming that manifold 12 and ink pressure chamber 22 act as constant pressure boundaries, the approximate resonant frequency of inlet channel can be calculated using the equation $f=a/2L$, where "a" is the velocity of sound in a fluid and "L" is the inlet channel length. In like manner for the combined outlet channel structures, assuming that orifice 14 behaves as a closed (zero velocity) boundary, the approximate resonant frequency of the combined outlet channel structures can be calculated using the equation $f=a/4L$.

Referring to Table 1, ink-jet 10 has an inlet channel length of about 6.35 millimeters and an a combined outlet channel length of about 3.50 millimeters. The speed of sound in a fluid is about 1,000 meters per second. Therefore, the inlet resonant frequency is approximately 79 KHz and the outlet resonant frequency is approximately 73 KHz.

The foregoing theory has been applied in practice together with the fluid flow theory described in the parent of this application to design PZT drive waveforms for ink-jet 10. The electrical waveforms generated by transducer driver 36 concentrate energy in the frequency range of the desired mode while suppressing energy in other competing modes and at the resonant frequencies of the inlet and outlet channel structures of ink jet 10.

Figure 3:
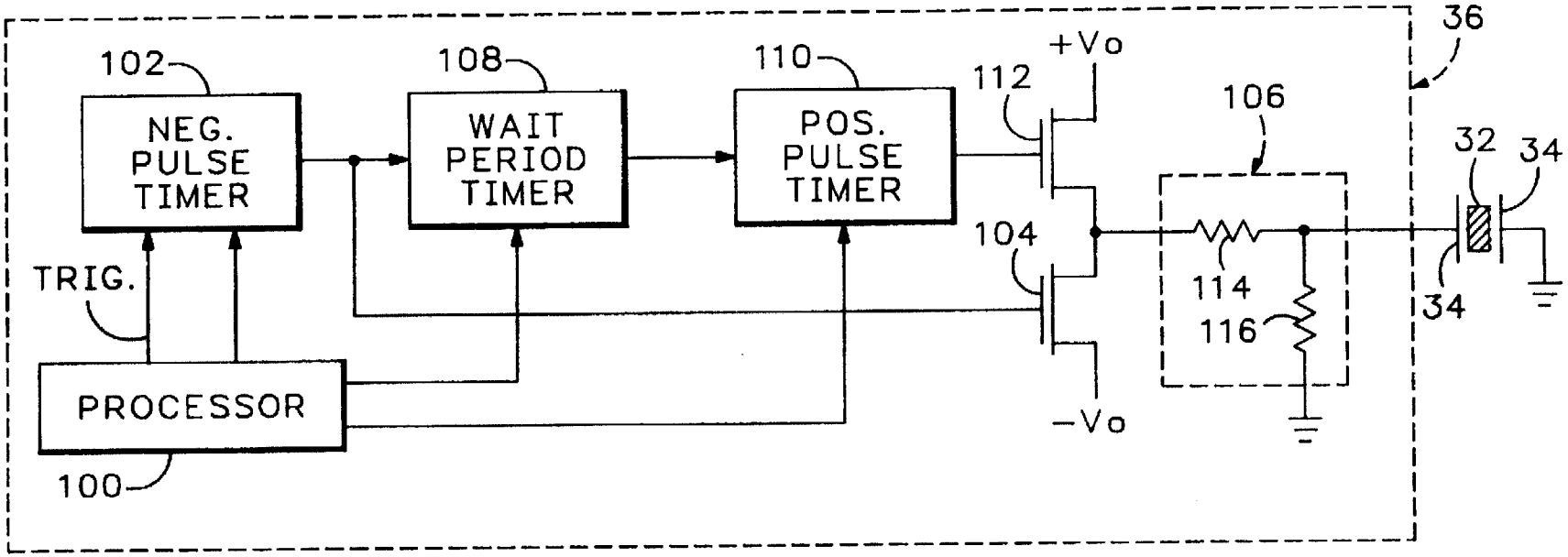
Fig.3 (PRIOR ART)
FIG. 3 is a schematic block diagram showing the electrical interconnections of a prior art apparatus used to generate a PZT drive waveform according to this invention.

FIG. 3 diagrammatically shows a conventional apparatus representative of transducer driver 36 that is suitable for generating PZT drive waveforms according to this invention. Of course, other waveform generators may be employed.

A processor 100 provides a trigger pulse to negative pulse timer 102 that drives a field-effect transistor 104 such that a resistor network 106 is electrically connected to a negative voltage source $-V_0$ for a time period determined by processor 100.

When negative pulse timer 102 times out, a wait period timer 108 is triggered for a wait time period determined by processor 100. When wait period timer 108 times out, a positive pulse timer 110 drives a field-effect transistor 112 such that resistor network 106 is electrically connected to a positive voltage source $+V_0$ for a time period determined by processor 100.

Resistor network 106 is electrically disconnected from voltage sources $+V_0$ and $-V_0$ during periods when timers 102 and 110 are inactive or when timer 108 is active. A bipolar electrical drive is thereby produced that is electrically connected through resistor network 106 to metal one of film layers 34 of transducer 32.

Resistor network 106 includes a series resistor 114 having a value ranging between 5,000 and 6,000 ohms and a shunt resistor 116 having a value of about 5,560 ohms. Series resistor 114 is trimmed to a value that establishes a predetermined drop ejection velocity from ink jet 10 as described in U.S. Pat. No. 5,212,497, issued May 18, 1993 for ARRAY JET VELOCITY NORMALIZATION, which is assigned to the assignee of this application. This application is not directly concerned with establishing the predetermined ejection velocity, but rather describes how to maintain a substantially constant ejection velocity over a wide range of drop ejection rates.

Figure 4:
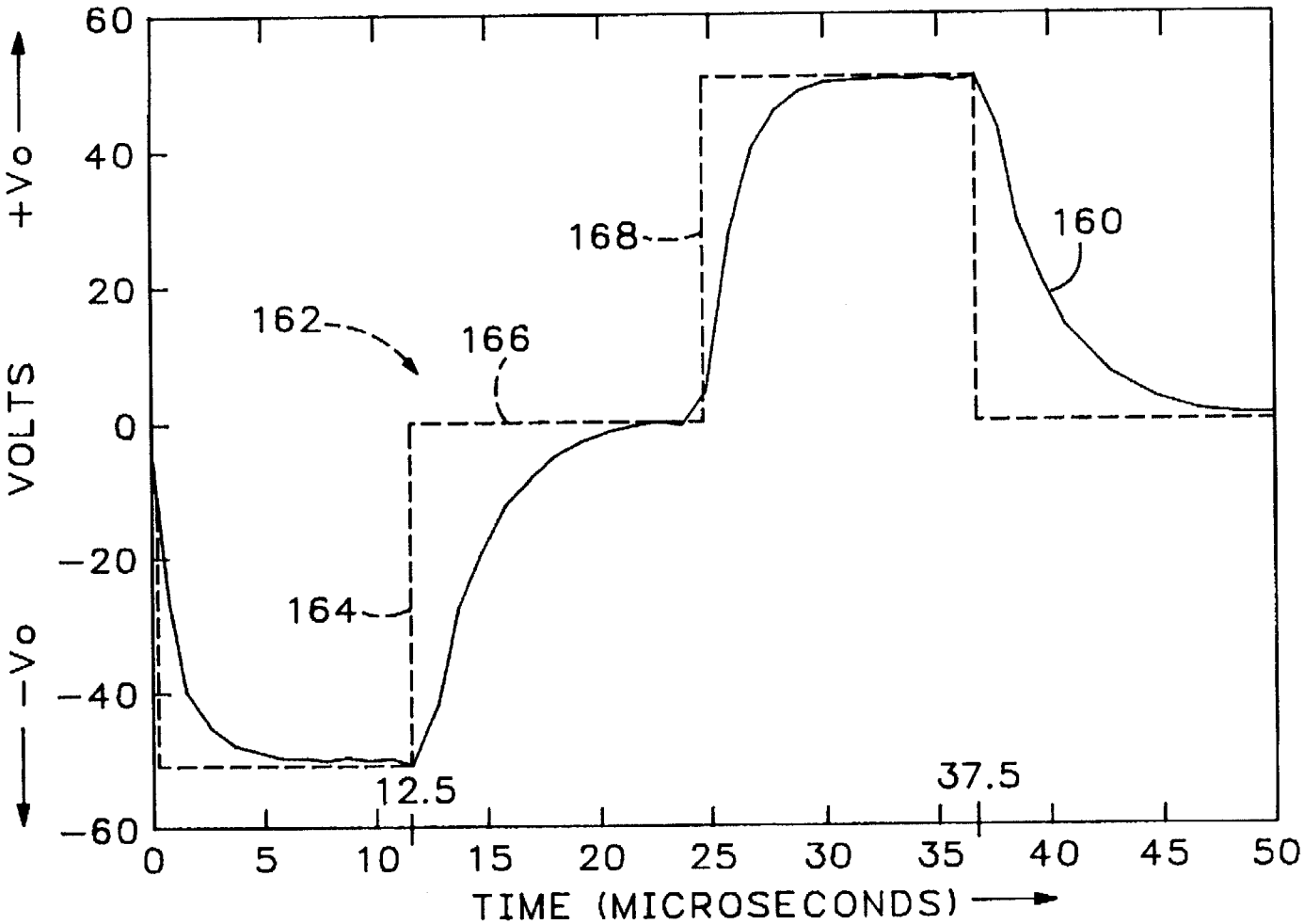
FIG. 4 is a waveform diagram showing a preferred electrical voltage versus timing relationship of a PZT drive waveform used to produce ink drops at a high repetition rate in a manner according to this invention.

FIG. 4 shows a preferred PZT drive waveform 160 that provides a substantially constant mode zero drop ejection velocity at drop ejection rates approaching 14 KHz. Drive waveform 160 is shaped to concentrate energy around the dominant (Helmholtz) resonant frequency and to suppress energy near the resonant frequencies of input channel 18 and the combined outlet channel structures. Many drive waveform shapes can achieve the same result, but drive waveform 160 achieves the desired result by having transducer driver 36 (FIG. 3) generate a bipolar drive waveform 162 that includes a 12.5-microsecond duration negative 50-volt pulse 164 separated by a 12.5-microsecond wait period 166 from a 12.5-microsecond duration positive 50-volt pulse 168. Suitable drive waveforms may be generated in which each of the above-described pulse durations and wait periods may be in a range from about 4-microseconds to about 30-microseconds.

Pressure transducer 32 has a characteristic capacitance of about 500 picofarads which together with resistor network 106 forms a simple resistance-capacitance ("RC") filter that causes the characteristic rolled-off shape of drive waveform 160. Skilled workers will recognize that other RC value combinations are possible and that bipolar waveform 162 may be suitably adjusted to compensate.

Figure 5:
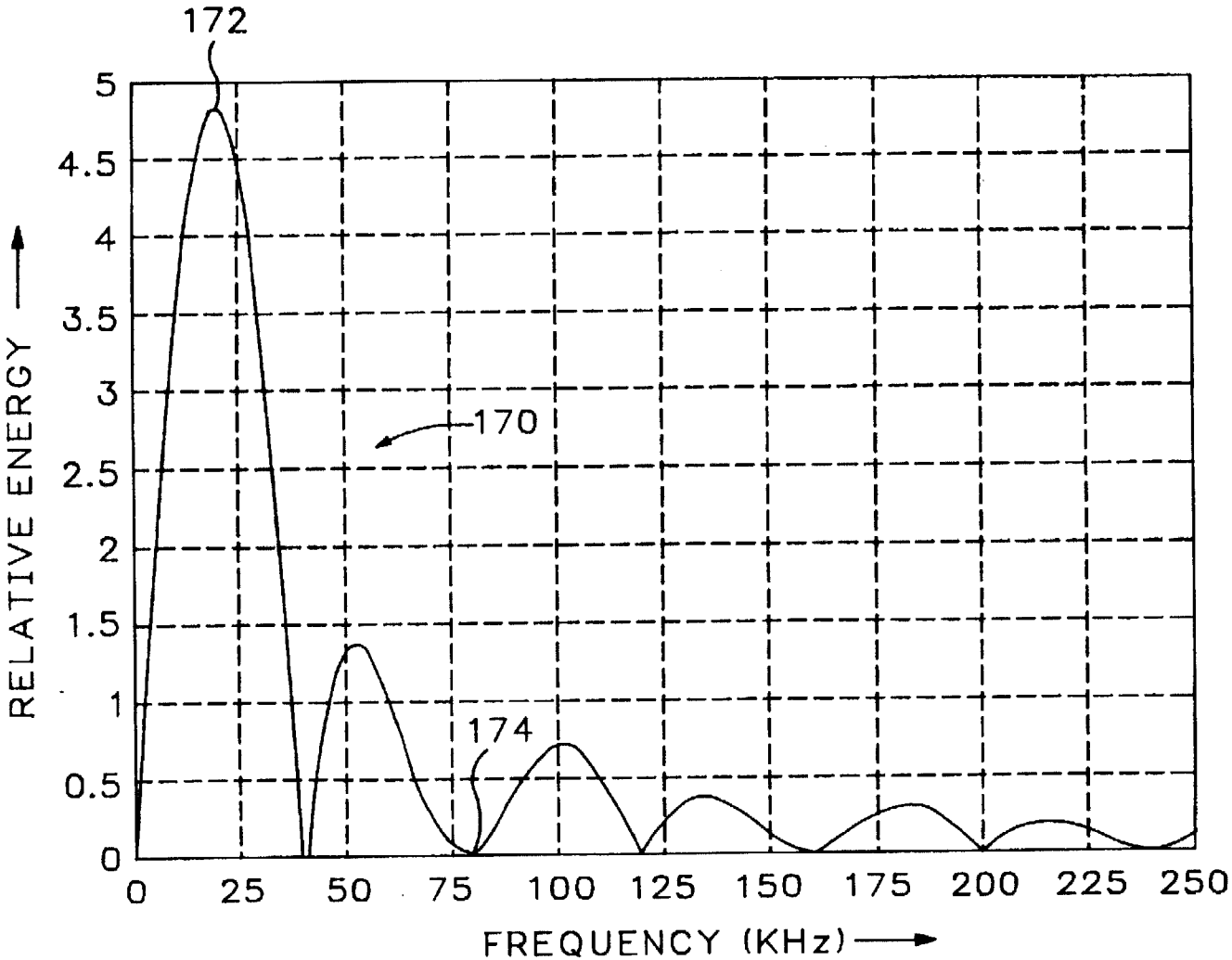
FIG. 5 graphically shows spectral energy as a function of frequency for the PZT drive waveform shown in FIG. 4.

FIG. 5 shows a Fourier series approximation of an energy distribution 170 versus frequency resulting from driving pressure transducer 32 with drive waveform 160. Energy distribution 170 is concentrated at a peak 172 surrounding the 19 KHz dominant resonant frequency of ink-jet 10 and is suppressed at a null 174 near the respective inlet and outlet channel resonant frequencies of 79 KHz and 73 KHz.

Figure 6:
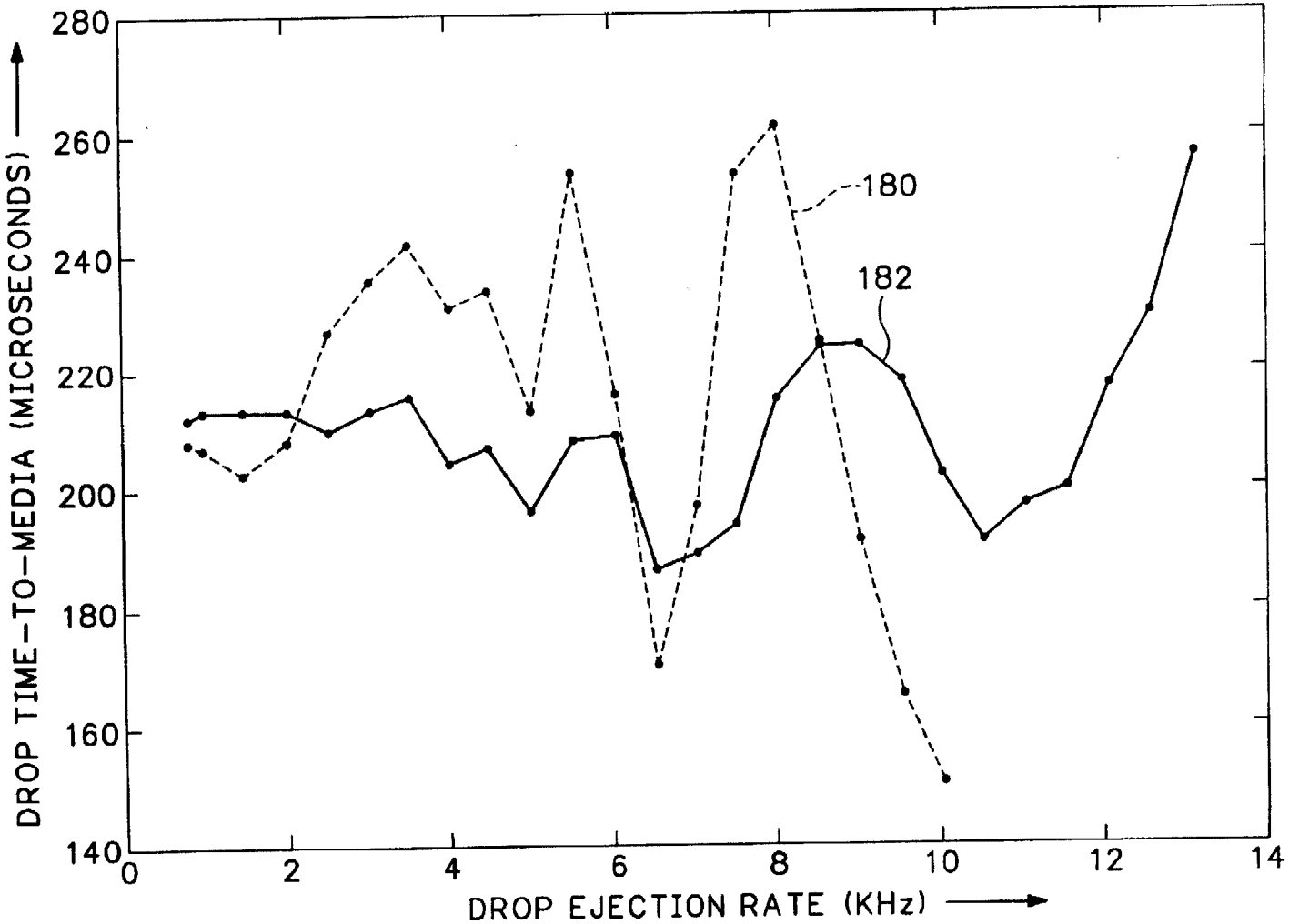
FIG. 6 graphically compares ink drop time-to-paper as a function of drop ejection rate for ink drops ejected with a prior art PZT drive waveform that does not suppress energy at the frequency of an inlet channel and with the preferred drive waveform (160) shown in FIG. 4.

FIG. 6 graphically compares the jetting performance that results from driving ink-jet 10 with a prior art waveform and with preferred drive waveform 160 of FIG. 4. The prior art drive waveform was shaped as described in U.S. Pat. No. 5,170,177 to concentrate energy around a 19 KHz dominant frequency but to minimize energy only at the 73 KHz resonant frequency of the outlet channel. The prior art waveform results when transducer driver 36 (FIG. 3) generates a bipolar drive waveform having a 12.0-microsecond duration negative 50-volt pulse separated by a 3.0-microsecond wait period from an 11.0-microsecond duration positive 50-volt pulse.

Ink-jet 10 was driven with the prior art waveform and the time required for ejected ink drops to travel from orifice 14 to a print medium spaced 0.81 millimeter away was recorded versus the drop ejection rate. A curve 180 shows that 100-microsecond time-to-media variations result when ink-jet 10 is driven by the prior art waveform over a range of ejection rates from one to 10 KHz. The 50 percent time-to-media variation can cause drop placement errors that limit printing speed in high-resolution printing applications.

Ink-jet 10 was then driven with preferred drive waveform 160, and the time required for ejected ink drops to travel from orifice 14 to a print medium spaced 0.81 millimeter away was again recorded versus the drop ejection rate. A curve 182 shows that 65-microsecond time-to-media variations result when ink-jet 10 is driven by preferred drive waveform 160 over a range of ejection rates from one to 13 KHz. Ejection rates of up to 15 KHz can be achieved using ink-jet 10. Time-to-media variations of 40 microseconds result if ink-get 10 is limited to an ejection rate of 12.5 KHz. The resulting 20 to 30 percent time-to-media variations represent a 50 percent variation improvement combined with a 25 percent to 30 percent drop ejection rate improvement.

High-speed, high-resolution printing applications may likewise be improved by using transducer drive waveforms designed and shaped according to the principles described in this application.

Alternative embodiments of portions of this invention include, for example, its applicability to jetting various fluid types including, but not limited to, aqueous and phase-change inks of various colors.

Skilled workers will realize that waveforms other than waveform 160 can achieve the desired results and that a spectrum analyzer or fast-Fourier-transform displaying oscilloscope may be used to view a resulting energy spectrum while shaping a waveform to achieve a predetermined energy distribution. Moreover, filtering other than RC filtering, or no filtering at all may be employed to achieve the desired drive waveform energy distribution.

It should be noted that this invention is useful in combination with various prior art techniques including dithering and electric field drop acceleration to provide further enhanced image quality and drop placement accuracy.

In summary, the invention is amenable to any fluid jetting drive mechanism and architecture capable of providing the required drive waveform energy distribution to a suitable orifice.

It will be obvious to skilled workers that many changes may be made to the details of the above-described embodiments of this invention without departing from the underlying principles thereof. For example, electromechanical transducers other than the PZT bending-mode type described may be used. Shear-mode, annular constrictive, electrostrictive, electromagnetic, and magnetostrictive transducers are suitable alternatives. Similarly, although described in terms of electrical energy waveforms to drive the transducers, any other suitable energy form could be used to actuate the transducer, such as, but not limited to, acoustical or microwave energy. Where electrical waveforms are employed, the desired energy distribution can be equally well established by unipolar or bipolar pairs or groups of pulses. Accordingly, it will be appreciated that this invention is, therefore, applicable to fluid ejection applications other than those found in ink-jet printers. The scope of the present invention should be determined, therefore, only by the following claims.

We claim:

1. In an apparatus for ejecting from an orifice drops of a fluid having a substantially constant ejection velocity over a range of drop ejection repetition rates, the apparatus conveying the fluid from a fluid manifold through an inlet channel to a pressure chamber and from the pressure chamber through a combined outlet channel to the orifice, the inlet channel having a first length and a first acoustic resonant frequency and the combined outlet channel having a second length and a second acoustic resonant frequency, an improvement for increasing the range of drop ejection rates comprising in combination:

a transducer driver generating an electrical waveform that repeats over a range of drop ejection repetition rates ranging from about 1 kilohertz to about 15 kilohertz, each repetition of the electrical waveform having a predetermined spectral energy distribution that includes a peak of the spectral energy around a dominant resonant frequency of the fluid in the orifice and at least a 30 decibel reduction below the peak of the spectral energy around the first and second acoustic resonant frequencies, which are determined respectively by dividing a speed of sound in the fluid by two times the first length and four times the second length; and a piezoelectric transducer coupling each repetition of the electrical waveform to the pressure chamber to eject a drop of the fluid from the orifice at the substantially constant ejection velocity.

2. The apparatus of claim 1 in which the dominant resonant frequency is a Helmholtz resonance resulting from co-action among the pressure chamber, the inlet channel, the combined outlet channel, and the orifice.

3. The apparatus of claim 1 in which the apparatus further includes an offset channel port, an offset channel, and an outlet channel, and the combined outlet channel is formed from at least one of the offset channel port, the offset channel, and the outlet channel.

4. The apparatus of claim 1 in which the first length is about twice the second length, and the first and second acoustic resonant frequencies are substantially equal.

5. The apparatus of claim 1 in which the predetermined spectral energy distribution of each repetition of the electrical waveform is established by a bipolar pair of pulses separated by a wait period.

6. The apparatus of claim 1 in which the orifice is an ink-jet orifice and the fluid is ink.

7. In an ink jet for ejecting from an orifice drops of an ink having a dominant resonant frequency in the orifice and a substantially constant ejection velocity over a range of drop ejection repetition rates, the ink jet conveying the ink from a fluid manifold through an inlet channel to a pressure chamber and from the pressure chamber through a combined outlet channel to the orifice, the inlet channel having a first length and a first acoustic resonant frequency and the combined outlet channel having a second length and a second acoustic resonant frequency, a method for increasing the range of drop ejection rates comprising the steps of:

determining the first acoustic resonant frequency by dividing a speed of sound in the ink by two times the first length;

determining the second acoustic resonant frequency by dividing a speed of sound in the ink by four times the second length;

designing an electrical waveform having a predetermined spectral energy distribution including a peak of the spectral energy around the dominant resonant frequency of the ink in the orifice and at least a 30 decibel reduction below the peak of the spectral energy around the first and second acoustic resonant frequencies;

generating repetitions of the electrical waveform over a range of drop ejection repetition rates ranging from about 1 kilohertz to about 15 kilohertz; and coupling with a piezoelectric transducer each repetition of the electrical waveform into the pressure chamber to eject a drop of the ink from the orifice at the substantially constant ejection velocity.

8. The method of claim 7 in which the designing step includes viewing the electrical waveform with at least one of a spectrum analyzer and a fast-Fourier-transform displaying oscilloscope, and shaping the electrical waveform to achieve the predetermined spectral energy distribution.

9. The method of claim 7 in which each repetition of the generating step includes the steps of:

forming an electrical pulse having a first relative voltage polarity and a first duration;

waiting a predetermined time period; and forming an electrical pulse having a second relative voltage polarity and a second duration.

10. In an apparatus for ejecting from an orifice drops of a fluid having a substantially constant ejection velocity over a range of drop ejection repetition rates, the apparatus conveying the fluid from a fluid manifold through an inlet channel to a pressure chamber and from the pressure chamber through a combined outlet channel to the orifice, the inlet channel having a first length and a first acoustic resonant frequency and the combined outlet channel having a second length and a second acoustic resonant frequency, an improvement for increasing the range of drop ejection rates comprising in combination:

a transducer driver generating an electrical waveform that repeats over a range of drop ejection repetition rates ranging from about 1 kilohertz to about 15 kilohertz, each repetition of the electrical waveform having a predetermined spectral energy distribution that includes a peak of the spectral energy around a resonant frequency of the fluid in the orifice and at least a 30 decibel reduction below the peak of the spectral energy around the first and second acoustic resonant frequencies, which are determined respectively by dividing a speed of sound in the fluid by two times the first length and four times the second length; and a piezoelectric transducer coupling each repetition of the electrical waveform to the pressure chamber to eject a drop of the fluid from the orifice at the substantially constant ejection velocity.

11. The apparatus of claim 10 in which the concentration of the energy input around the resonant frequency of the fluid in the orifice is selected to excite in the orifice a modal meniscus shape that is selected from a group consisting of a mode zero type, a mode one type and a mode two type.

12. The apparatus of claim 10 in which the resonant frequency is a Helmholtz resonance resulting from co-action among the pressure chamber, the inlet channel, the combined outlet channel, and the orifice.

13. The apparatus of claim 10 in which the apparatus further includes an offset channel port, an offset channel, and an outlet channel, and the combined outlet channel is formed from at least one of the offset channel port, the offset channel, and the outlet channel.

14. The apparatus of claim 10 in which the first length is about twice the second length, and the first and second acoustic resonant frequencies are substantially equal.

15. The apparatus of claim 10 in which the predetermined spectral energy distribution of each repetition of the electrical waveform is established by a bipolar pair of pulses separated by a wait period.

16. The apparatus of claim 10 in which the orifice is an ink-jet orifice and the fluid is ink.

* * * * *